US009556840B2

(12) United States Patent
Dölker

(10) Patent No.: US 9,556,840 B2
(45) Date of Patent: Jan. 31, 2017

(54) METHOD FOR RAIL PRESSURE REGULATION IN AN INTERNAL COMBUSTION ENGINE

(71) Applicant: MTU Friedrichshafen GmbH, Friedrichshafen (DE)

(72) Inventor: Armin Dölker, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 125 days.

(21) Appl. No.: 14/678,553

(22) Filed: Apr. 3, 2015

(65) Prior Publication Data

US 2015/0211457 A1 Jul. 30, 2015

Related U.S. Application Data

(63) Continuation of application No. PCT/EP2013/002828, filed on Sep. 19, 2013.

(30) Foreign Application Priority Data

Oct. 4, 2012 (DE) ..... 10 2012 019 457

(51) Int. Cl.

| | |
|---|---|
| ***F02M 69/54*** | (2006.01) |
| ***F02M 55/02*** | (2006.01) |
| ***F02D 41/04*** | (2006.01) |
| ***F02D 41/38*** | (2006.01) |
| ***F02M 37/22*** | (2006.01) |
| *F02D 41/14* | (2006.01) |

(52) U.S. Cl.

CPC ..... *F02M 55/025* (2013.01); *F02D 41/045* (2013.01); *F02D 41/3845* (2013.01); *F02M 37/22* (2013.01); *F02D 2041/1422* (2013.01); *F02D 2041/1432* (2013.01)

(58) Field of Classification Search

CPC ..... F02M 55/025; F02M 37/22; F02D 41/045; F02D 41/0836; F02D 41/0845; F02D 41/0854; F02D 41/0863; F02D 2041/1432; F02D 2041/1422

USPC ..... 123/456, 457

See application file for complete search history.

(56) References Cited

U.S. PATENT DOCUMENTS

| | | | | |
|---|---|---|---|---|
| 6,035,829 | A | 3/2000 | Hartke et al. | |
| 6,840,228 | B2 | 1/2005 | Yomogida et al. | |
| 7,856,961 | B2 | 12/2010 | Doelker et al. | |
| 8,844,501 | B2 | 9/2014 | Dölker | |
| 2014/0109876 | A1 * | 4/2014 | Dolker | F02D 41/221 123/479 |

FOREIGN PATENT DOCUMENTS

| | | |
|---|---|---|
| DE | 10 2008 055 931 A1 | 5/2010 |
| EP | 0 259 544 A1 | 3/1988 |
| EP | 1 447 546 A2 | 8/2004 |

OTHER PUBLICATIONS

International Search Report dated Nov. 20, 2013 for International Application No. PCT/EP2013/002828 (4 pages).

* cited by examiner

*Primary Examiner* — Hai Huynh
(74) *Attorney, Agent, or Firm* — Taylor IP, P.C.

(57) ABSTRACT

The invention describes a method and an arrangement for the regulation of the rail pressure in an internal combustion engine. In the method, the rail pressure is regulated, with a target high pressure being predefined. Said target high pressure is filtered, before being input, by way of a target high pressure filter which is configured as a dynamic target high pressure filter.

12 Claims, 9 Drawing Sheets

METHOD FOR RAIL PRESSURE REGULATION IN AN INTERNAL COMBUSTION ENGINE

CROSS REFERENCE TO RELATED APPLICATIONS

This is a continuation of PCT application No. PCT/EP2013/002828, entitled "METHOD FOR RAIL PRESSURE REGULATION IN AN INTERNAL COMBUSTION ENGINE", filed Sep. 19, 2013, which is incorporated herein by reference.

BACKGROUND OF THE INVENTION

1. Field of the Invention

The invention relates to a method and arrangement for the regulation of the rail pressure in an internal combustion engine, wherein the rail pressure is regulated by way of a control unit.

2. Description of the Related Art

Various fuel injection systems are commonly used in internal combustion engines. Common rail fuel injection describes a fuel injection system wherein a high pressure pump brings fuel to a high pressure level. The fuel comes into a pipe system, known as the rail, where it is under pressure. The common rail system allows separation of the pressure generation from the actual injection process. The rail pressure is regulated by a pressure control valve or a suction throttle and is monitored by a rail pressure sensor. An automatic control is provided for this, wherein the target rail pressure is preset.

The internal combustion engine can basically be in a steady state operational state or a transient operational state. In the steady state operational state the rotational speed, as well as the rail pressure are already stable. In the transient operational state this is not the case. In order to reduce fluctuations of the target high pressure in the steady state operational state, a target high pressure filter having a long dwell time is required. In contrast, in the transient operation a target high pressure filter having a very short dwell time is required. In the prior art, a PT1-filter with a constant time constant was used. In order to enable a good steady state performance of the high pressure control circuit this time constant must be set very high. This had the disadvantage that the target high pressure is delayed too much during transient operations.

SUMMARY OF THE INVENTION

One embodiment of the method according to the invention serves to regulate rail pressure in an internal combustion engine, wherein the rail pressure is regulated by way of a controller, whereby a target high pressure is preset which is filtered by way of a target high pressure filter prior to input into the control system. A dynamic target high pressure filter is used as the target high pressure filter whose filter parameter is varied, depending on the operational state of the internal combustion engine. Regulation occurs via a pressure regulator, a controller and a pressure sensor on the rail.

In one embodiment a time constant of the filter and in another embodiment a filter angle is varied as a filter parameter. In one embodiment a suction throttle is used as pressure regulator. A pressure regulating valve can be utilized alternatively or additionally on the rail. Steady state and transient operating conditions can be considered for the internal combustion engine. In the steady state operation the filter parameter, the time constant, or the filter angle are typically selected to a large value. In the transient operation the filter parameter, the time constant, or the filter angle are typically selected to a small value.

In one embodiment the transient air mass ratio is the decisive value for the differentiation of steady state and transient operation. The filter parameter may also be calculated over a curve from the transient air mass ratio. Moreover an arrangement to regulate rail pressure in an internal combustion engine that is suitable in particular for implementation of the previously discussed method is provided. This arrangement, which represents a high pressure control circuit includes a controller into which a target high pressure is input, and a target high pressure filter with which the target high pressure is filtered prior to input into the controller, wherein the target high pressure filter is designed dynamically, and whose filter parameter is variable in dependency on the operational condition of the internal combustion engine. A PT1-filter or a mean value filter can be used as dynamic target high pressure filter.

This method provides good filter performance in steady state operation with a large time constant or respectively large filter angle, and at the same time low filtration in transient operation with a small time constant or respectively small filter angle. This makes possible steep gradients in the target high pressure performance characteristics graph. In transient operation, emissions are reduced and the acceleration process improved. A calculation of the filter parameter, the time constant and/or the filter angle occurs hereby, in dependency on the transient air mass ratio. A PT1-filter is a transmission element which has a proportional transmission behavior with a delay of the first order.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
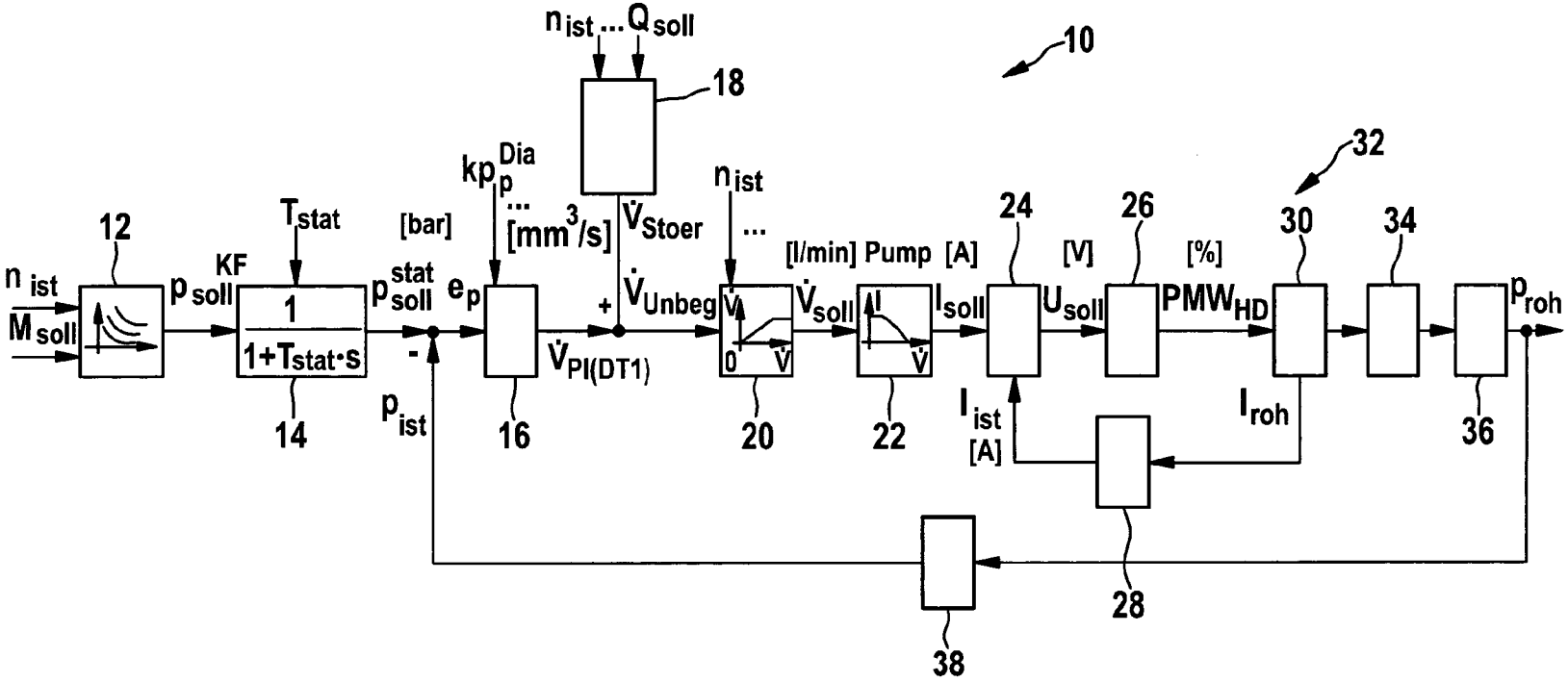
FIG. 1 illustrates a high pressure control circuit according to the current state of the art.

FIG. 1 illustrates a high pressure control circuit 10 of a common rail system according to the current state of the art.

Target high pressure $P_{soll}^{KF}$ is first determined from a three-dimensional performance characteristics graph 12 with input values of target torque $M_{soll}$ and engine speed $n_{ist}$. This is filtered by a PT1 filter 14 with the pre-definable time constant $T_{stat}$. The actual high pressure $P_{ist}$ is deducted from the target high pressure. The result is the high pressure control deviation $e_p$ which represents the input value for the high pressure regulator.

The drawing also shows a controller 16, a computation unit 18 for a disturbance variable whose output represents a volume flow, a unit 20 for limitation which outputs a manipulated variable, a performance characteristics graph 22 that represents a pump characteristic curve, flow regulator 24, a computation unit 26 for a PWM-signal, a flow filter 28, a suction throttle 30, whereby flow regulator 24, computation unit 26, suction throttle 30, and flow filter 28 form a flow control circuit 32, a rail pressure pump 34, a rail 36, and a pressure filter 38.

Note that contradictory criteria applies to the design of time constant $T_{stat}$:

The three-dimensional target high pressure performance characteristics graph 12 is determined by the engine test department. An attempt is made to be as flexible as possible, in order to implement random gradients. Very steep performance characteristics graph gradients can, however, lead to instabilities in steady state operation which is prevented by a large time constant $T_{stat}$ of the target high pressure filter. However, in dynamic processes, a large time constant $T_{stat}$ of the target high pressure filter leads to an undesirable delay of the target high pressure. The consequences could be higher emission values and a poorer load assumption behavior of the engine.

The present inventors recognized that a filter needs to be developed that would display a very strong delay behavior in steady state operation, and a low or no delay behavior in transient operation. In this way, it is possible to design the target high pressure performance characteristics graph almost randomly without having to accept disadvantages in transient operation. In addition, emissions can be reduced with such a filter since the target high pressure in the transient operation has a better transition behavior or, in other words, a shorter reaction time.

Figure 2:
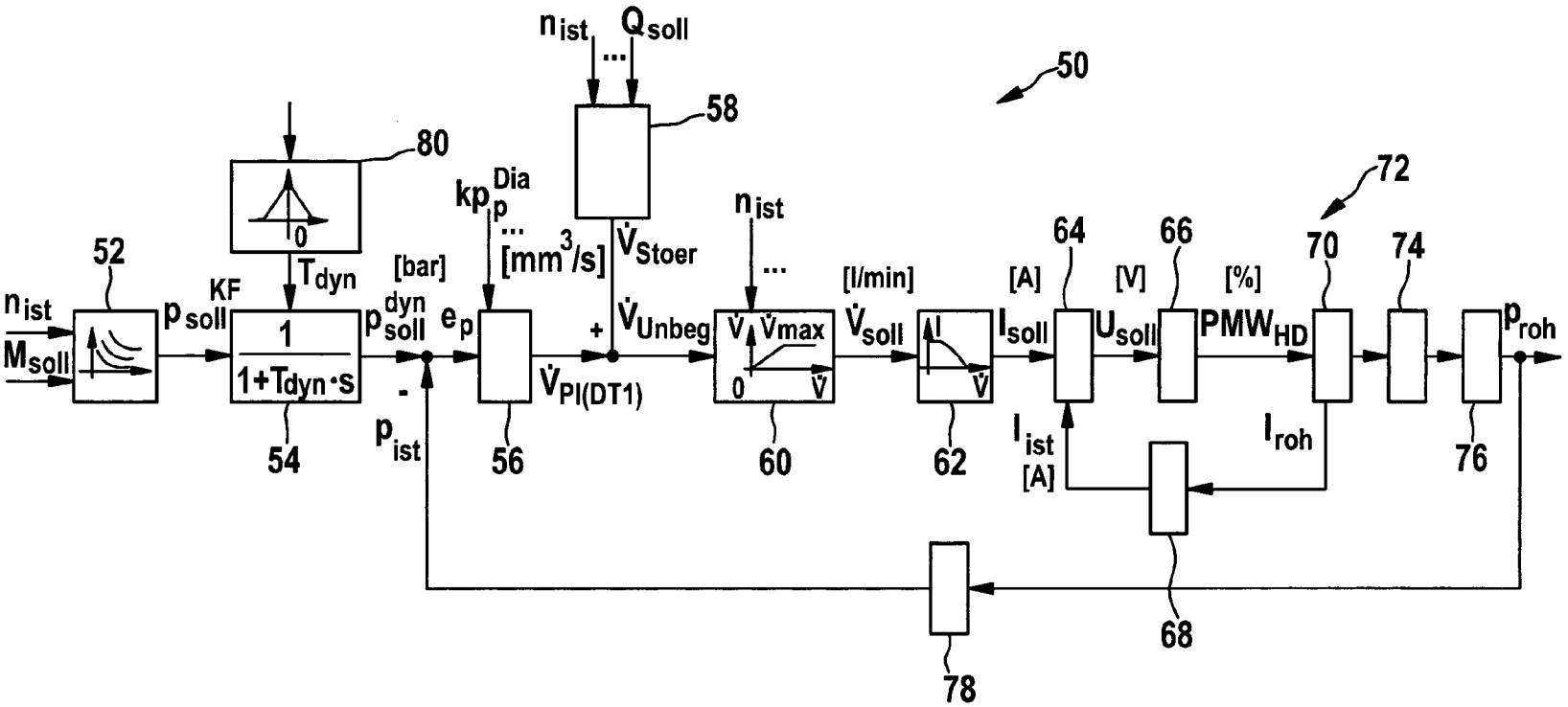
FIG. 2 illustrates one embodiment of the present invention.

FIG. 2 illustrates one embodiment of the invention which is identified with reference number 50. This arrangement 50 represents a high pressure control circuit with PT1 filter with a dynamic time constant. The illustration shows performance characteristics graph 52, a PT1-filter 54, a controller 56, a computation unit 58 for a disturbance variable whose output represents a volume flow, a unit 60 for limitation which outputs a manipulated variable, a performance characteristics graph 62 that represents a pump characteristic curve, a flow regulator 64, a computation unit 66 for a PWM signal, a flow filter 68, a suction throttle 70, whereby flow regulator 64, computation unit 66, suction throttle 70 and flow filter 68 form a flow control circuit 72, a rail pressure pump 74, a rail 76 and a pressure filter 78. The time constant of target high pressure filter 14 is no longer input constantly, but is instead calculated through a two-dimensional curve 80, depending on the transient air mass ratio.

Figure 3:
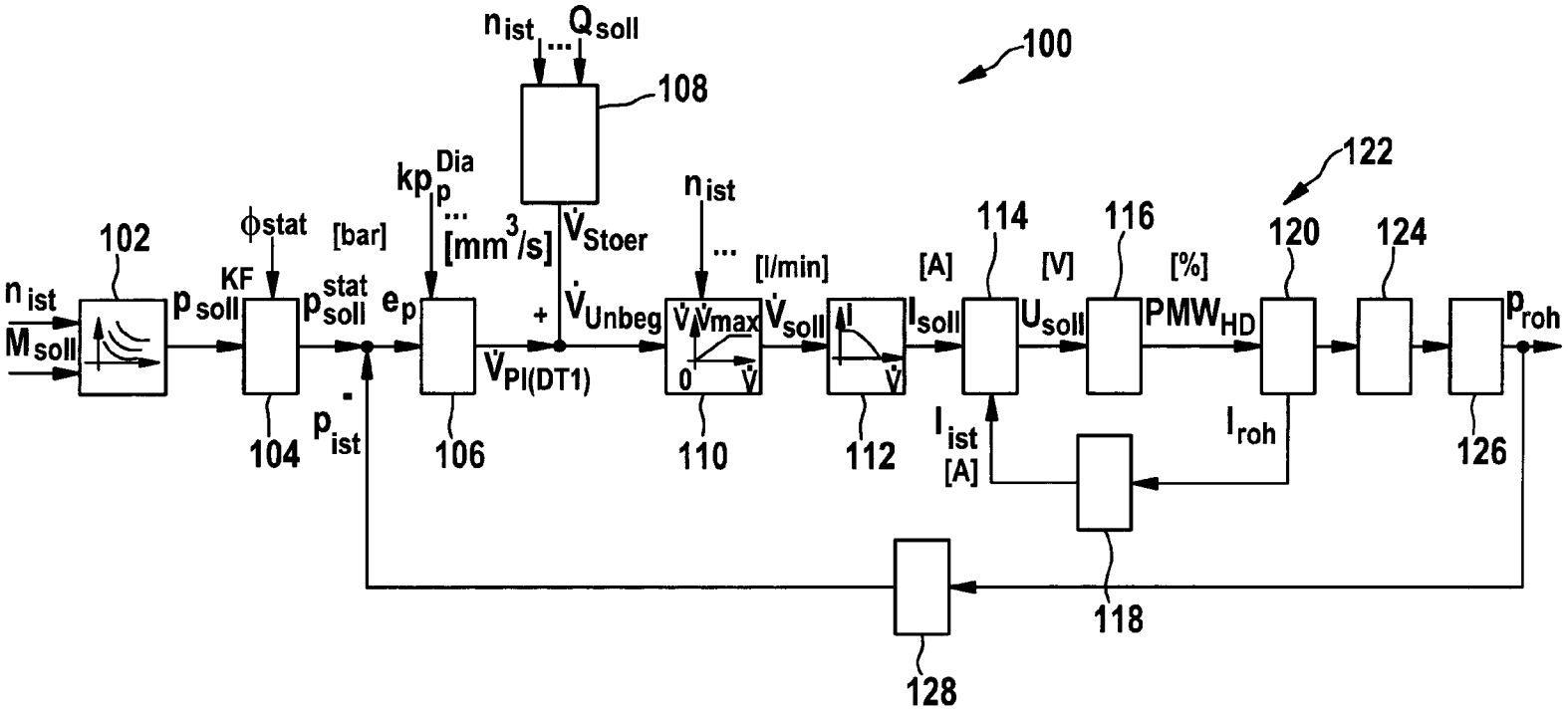
FIG. 3 illustrates an additional high pressure control circuit according to the current state of the art.

FIG. 3 illustrates a high pressure control circuit 100 with a mean value filter having a constant filter angle according to the current state of the art. The illustration shows a performance characteristics graph 102, a mean value filter 104, a controller 106, a computation unit 108 for a disturbance variable whose output represents a volume flow, a unit 110 for limitation which outputs a manipulated variable, a performance characteristics graph 112 that represents a pump characteristic curve, a flow regulator 114, a computation unit 116 for a PWM signal, a flow filter 118, a suction throttle 120, whereby flow regulator 114, computation unit 116, suction throttle 120 and flow filter 118 form a flow control circuit 122, a rail pressure pump 124, a rail 126, and a pressure filter 128.

Figure 4:
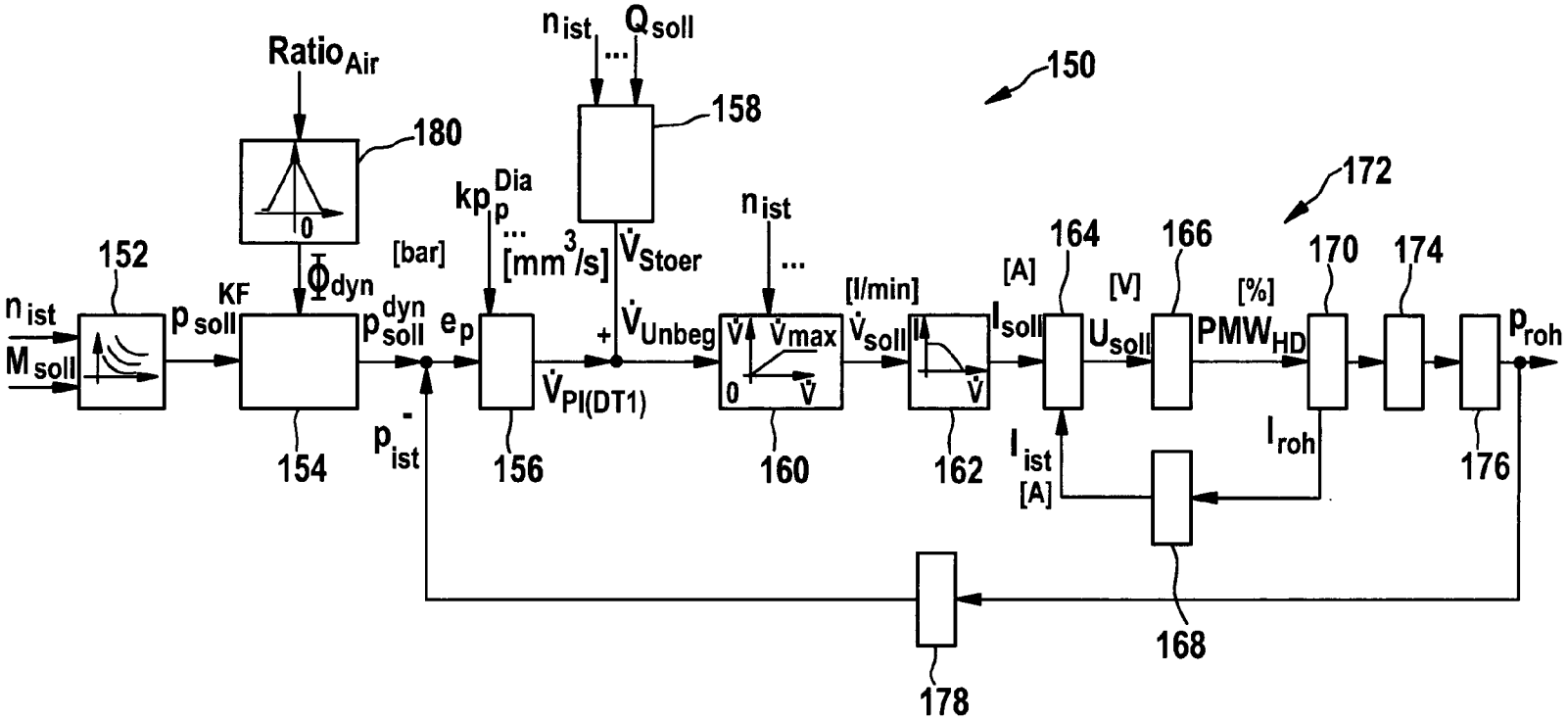
FIG. 4 illustrates another embodiment of the present invention.

FIG. 4 is an additional embodiment of the present invention 150, namely a high pressure control circuit having a dynamic filter angle. The illustration shows a performance characteristics graph 152, a mean value filter 154, a controller 156, a computation unit 158 for a disturbance variable whose output represents a volume flow, a unit 160 for limitation which outputs a manipulated variable, a performance characteristics graph 162 that represents a pump characteristic curve, a flow regulator 164, a computation unit 166 for a PWM signal, a flow filter 168, a suction throttle 170, whereby flow regulator 164, computation unit 166, suction throttle 170 and flow filter 168 form a flow control circuit 172, a rail pressure pump 174, a rail 176, and a pressure filter 178. The filter angle of mean value filter 154 is no longer input constantly, but is instead calculated through a two-dimensional curve 180, depending on the transient air mass ratio.

Figure 5:
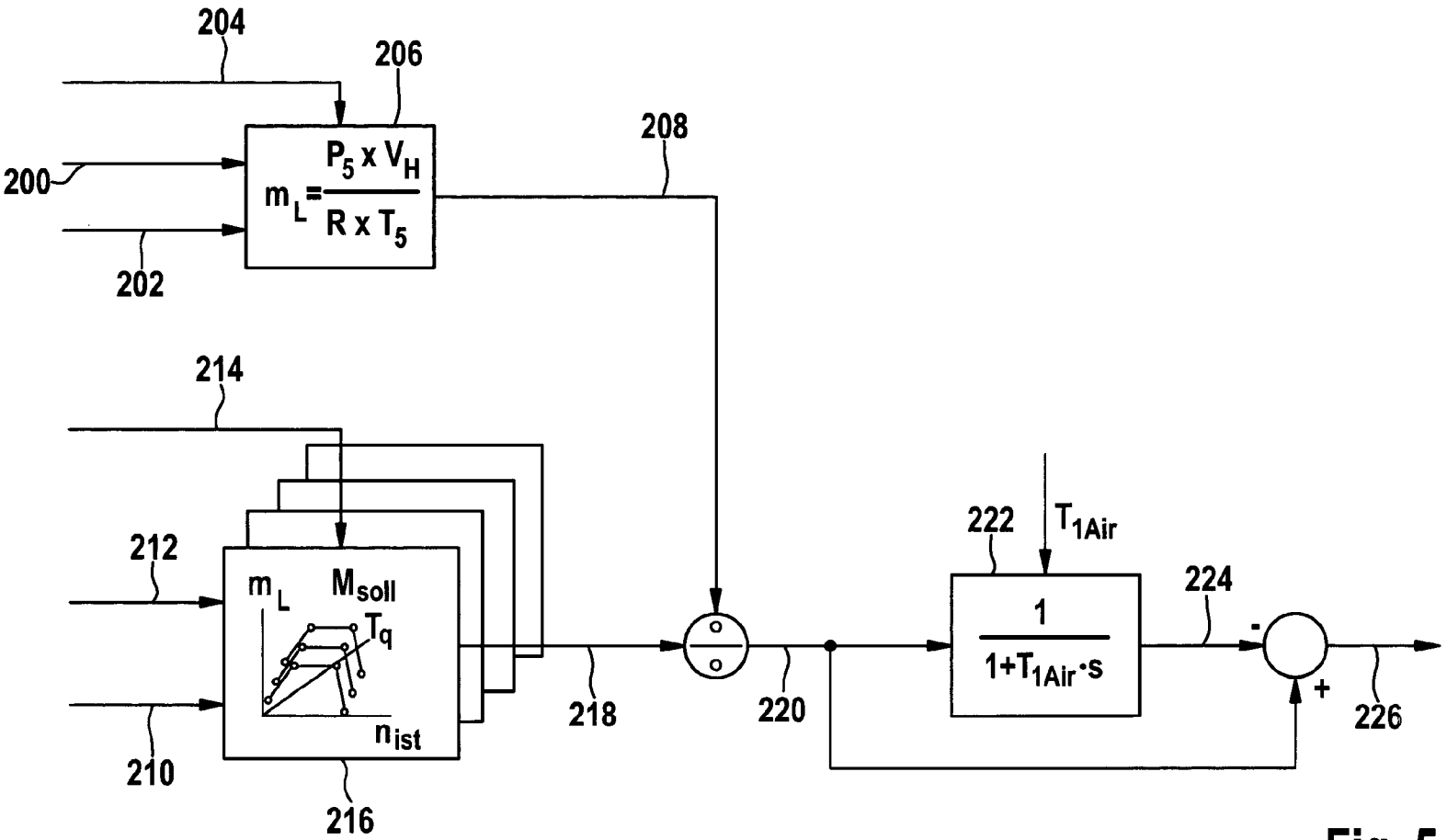
FIG. 5 illustrates the calculation of an air mass ratio.

The calculation of the transient air mass ratio is illustrated in FIG. 5: The actual air mass 208 $m_L$ is calculated in a computation unit 206 from charging air pressure 200 $p_5$, charging air temperature 202 $T_5$, and cylinder volume 204 $V_H$. From a 3D-performance characteristics graph, standard air mass 218 $m_{LN}$ is calculated from engine target torque 210 Tq and engine speed 212 nist, depending on load shifting condition 214. Actual air mass 208 is now divided by standard air mass 218, resulting in dimensionless actual air mass ratios 220. This is filtered with the assistance of a PT1 filter 222. The output variable of this filter is the filtered air mass ratio 224. Transient air mass ratio 226 is resultant from the difference of actual air mass ratio 220 and filtered air mass ratio 224.

Figure 6:
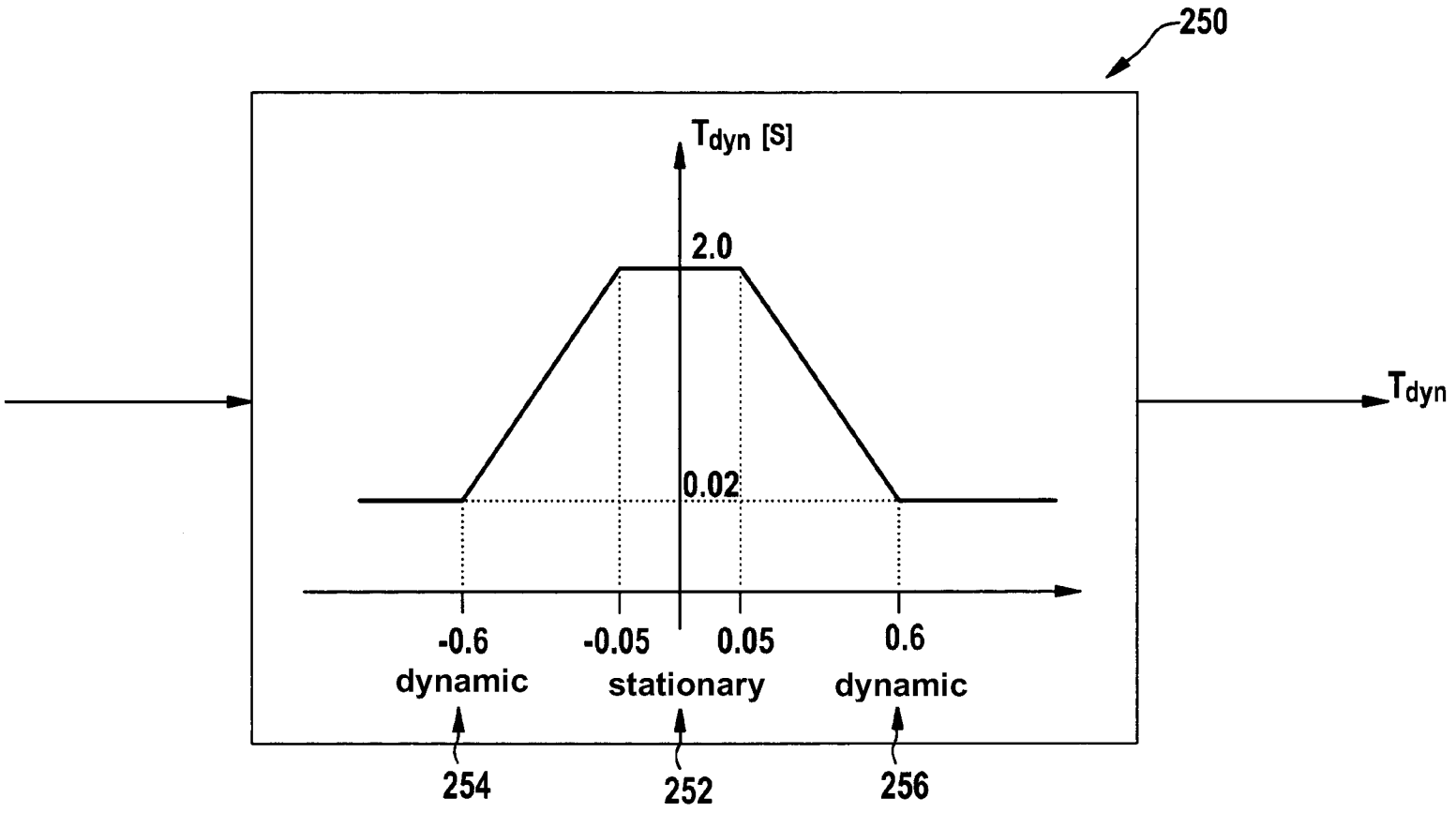
FIG. 6 illustrates the calculation of a dynamic time constant.

FIG. 6 shows an example of a two-dimensional curve 250 (dynamic time constant) over which the dynamic time constant $T_{dyn}$ of target high pressure filter is calculated. The curve is herein divided into three ranges: a steady state range 252 and two dynamic ranges 254 and 256. Steady state range 252 of curve 250 represents the steady state operating range of the engine. The transient air mass ratio assumes values herein of for example between −0.05 and 0.05. In the steady state operating range of the engine, the time constant of the filter is to assume large values, for example 2 seconds, which causes effective filtering of the target high pressure.

In the case of a transient process, for example when load shifting, the transient air mass ratio assumes larger values. In the case of a load increase these are negative, and in the case of a load decrease these are positive. For an increasing air mass ratio, a decreasing dynamic time constant $T_{dyn}$ is defined, so that two negative slopes of a curve result. If the transient air mass ratio exceeds the amount, for example value 0.6, then $T_{dyn}$ is held for 0.02 seconds constantly on the very small value.

In an additional embodiment of the target high pressure filter a mean value filter can for example also be utilized in addition to the PT1 filter. Averaging of the target high pressure can herein occur over an angle for example 720° crankshaft or a constant time for example 0.5 seconds.

Figure 7:
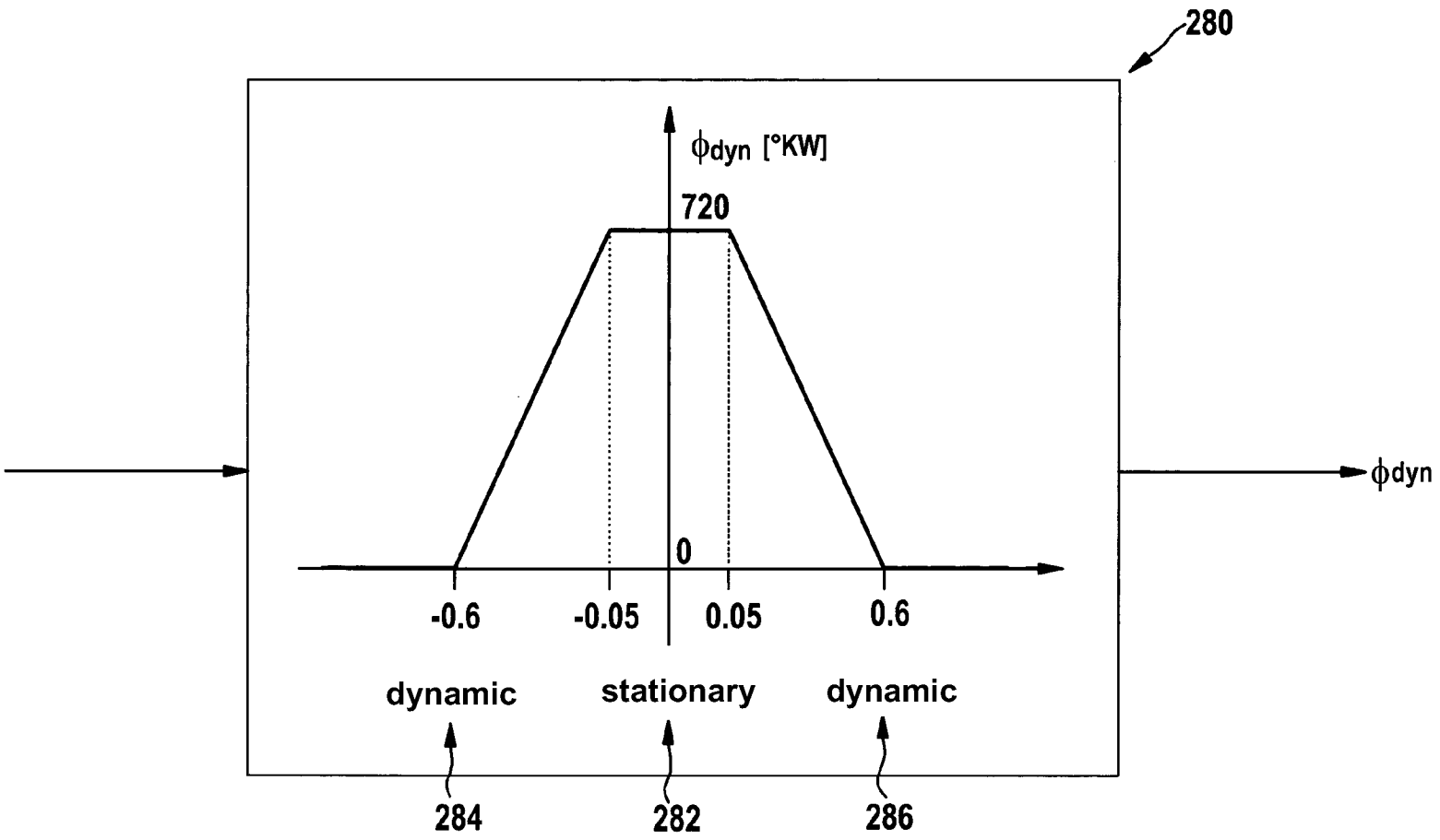
FIG. 7 illustrates the calculation of a dynamic filter angle.

A high pressure control circuit 100 with a mean value filter 104 is illustrated as the target high pressure filter in FIG. 3. The target high pressure is hereby averaged through the pre-settable filter angle $\Phi_{stat}$. FIG. 4 also shows a mean value filter 154 where the filter angle is determined over a two-dimensional curve 180 dependent on the transient air mass ratio. This curve 280 is shown in more detail in FIG. 7. A stationary operating range 282 is again limited by the two values −0.05 and 0.05 of the air mass ratio. The filter angle in this region is 720° crank angle. Dynamic or respectively transient ranges 284 and 286 are defined by values of the transient air mass ratio which are greater than 0.05. With an increasing air mass ratio the filter angle decreases, resulting in that the filter efficiency becomes less and less. If the air mass ratio ultimately reaches a value 0.6, then the filter angle is equal to 0° crank angle, thereby deactivating the filter. The curves illustrated in FIGS. 6 and 7 can obviously be applied.

Figure 8:
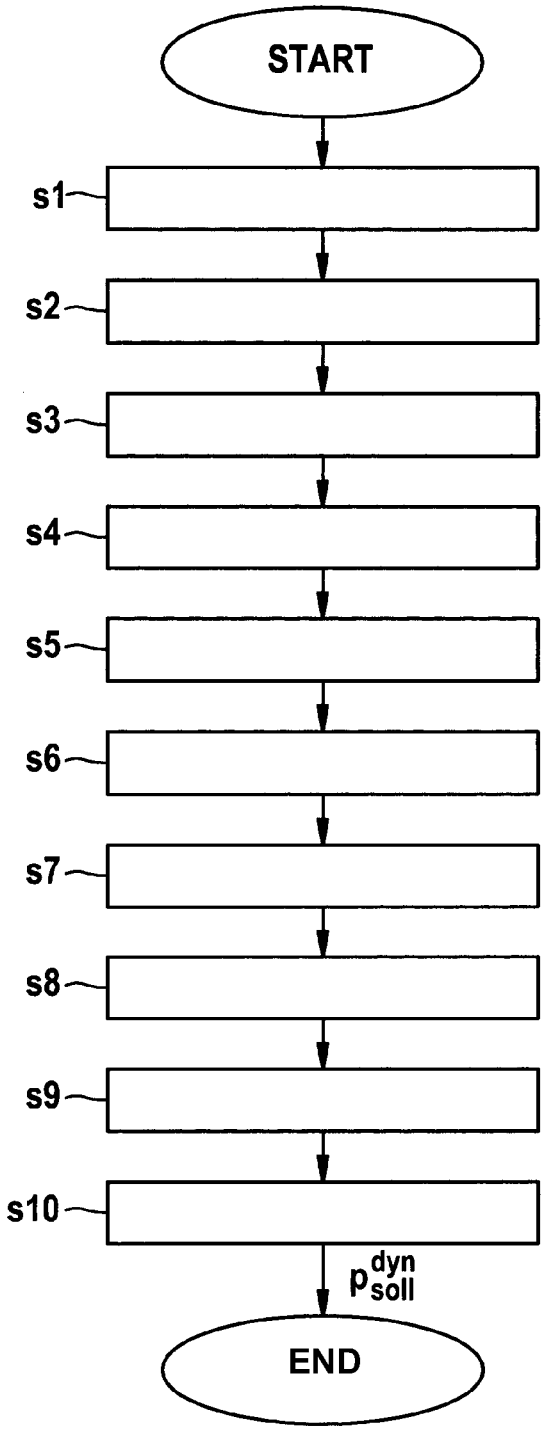
FIG. 8 illustrates the calculation of a target high pressure.

FIG. 8 shows a flow diagram for calculating the target high pressure. Engine speed $n_{ist}$ is calculated in step S1. Target torque $M_{soll}$ is calculated in step S2. This target torque is the sum of speed regulator output value and frictional torque. Standard air mass $m_{LN}$ is calculated in step S3. This is the output value of a three-dimensional performance characteristics graph with input values of engine speed $n_{ist}$ and target torque $M_{soll}$. In step S4 the actual air mass (charge air mass) $m_L$ is calculated, depending on the charge air pressure, the charge air temperature, and the cylinder volume. In step S5 the air mass ratio is calculated from the actual air mass and the standard air mass. In step S6 the air mass ratio is filtered through a PT1-filter. In step S7 the transient air mass ratio is calculated from the filtered air mass ratio and the actual air mass ratio. From the transient air mass ratio the dynamic filter time constant $T_{dyn}$ is calculated in step S8 from a 2-dimensional characteristic curve. From the engine target speed and the target torque the unfiltered target high pressure $p_{soll}^{KF}$ is calculated in step S9 with the assistance of a three-dimensional performance characteristics graph (high pressure demand map). The filtered target high pressure $p_{soll}^{dyn}$ is calculated in step S10 with the assistance of the target high pressure filter (high pressure demand filter). The target high pressure filter uses hereby the dynamic filter time constant $T_{dyn}$. This concludes the program flow chart.

Figure 9:
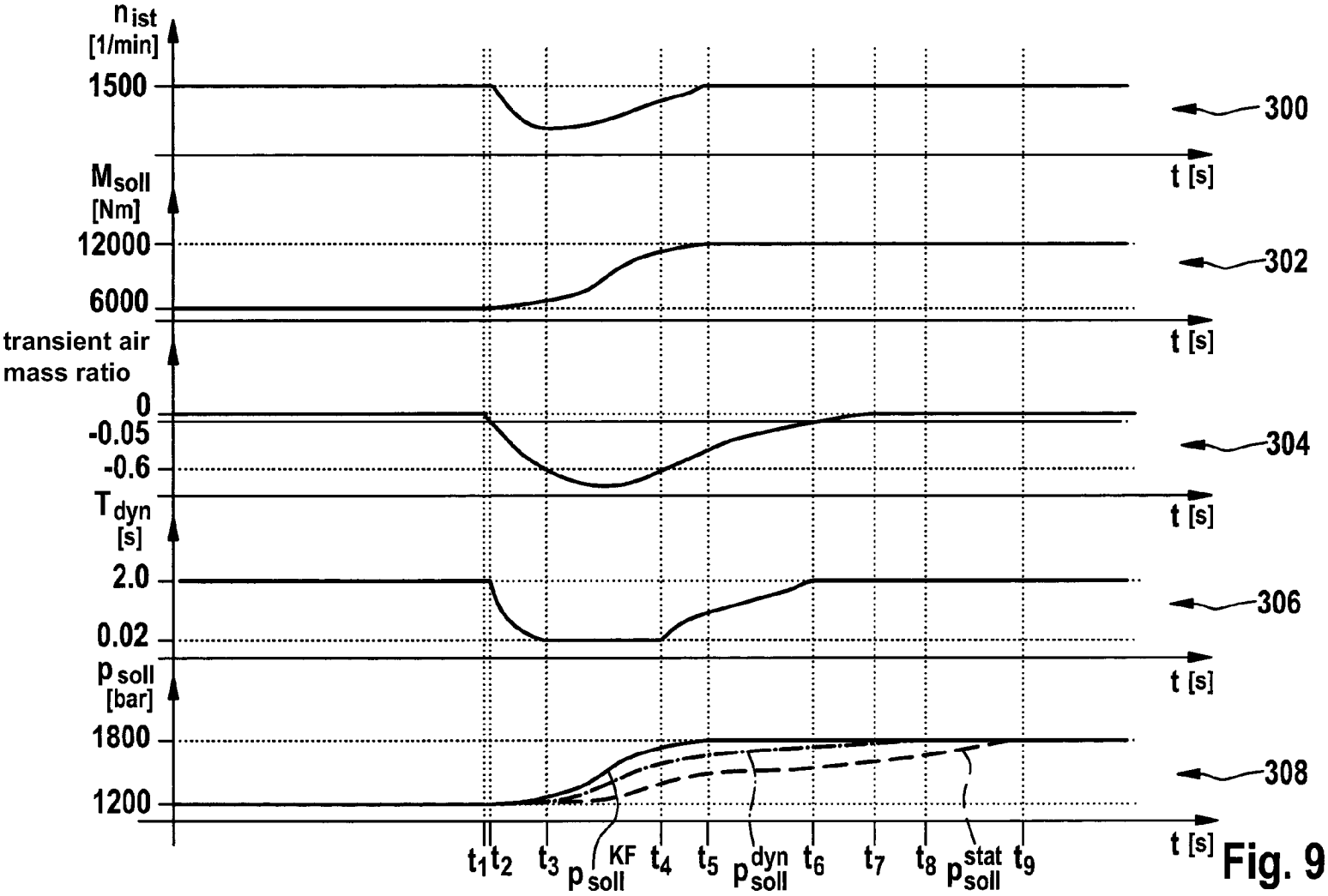
FIG. 9 illustrates time diagrams.

FIG. 9 represents the time diagrams of a load increase process of a generator motor. The first diagram 300 shows the motor speed $n_{ist}$. At point in time $t_1$ the load is increased, leading to a decline of the motor speed $n_{ist}$. At a point in time $t_5$ the motor speed has again built up to the target speed (1500 1/min.) Second diagram 302 shows the target torque ($M_{soll}$) of the motor. With the decline of the motor speed, the torque regulator increases the target torque, so that this increases as of point in time $t_1$. At point in time $t_5$ the target torque is also built up. The third diagram 304 shows the transient air mass ratio. In steady state operation, or in other words before point in time $t_1$, the transient air mass ratio has a zero value. By increasing the load to time point $t_1$ the actual air mass ratio decreases whereas the filtered air mass ratio only changes minimally at this time. This results in that the transient air mass ratio becomes negative. At time points $t_2$ and $t_6$ the transient air mass ratio assumes the value of −0.05, at time points $t_3$ and $t_4$ the value −0.6. At time point $t_2$ the transient air mass ratio has again built up to the stationary zero value.

The fourth diagram 306 shows time constant $T_{dyn}$ of the high pressure filter which was calculated from the transient air mass ratio according to FIG. 6. In steady state operation that is up to time point $t_1$, the time constant assumes the value of 2.0 seconds. After time point $t_2$, the time constant becomes smaller, since the transient air mass ratio falls below value −0.05 at this point in time. From time point $t_3$ to time point $t_4$ the transient air mass ratio is smaller than or equal to the value of −0.6. The time constant of the high pressure filter therefore assumes the value of 0.02 seconds in this time range according to FIG. 6. At time point $t_6$ the transient air mass ratio exceeds again the value of −0.05 and subsequently levels off at zero value. This results in that the time constant of the high pressure filter according to FIG. 6 increases from value 0.02 to value 2.0 seconds from time point $t_4$ to time point $t_6$, and as a result is identical with this value.

The fifth diagram 308 shows the target high pressure before $p_{soll}^{KF}$ and after $p_{soll}^{dyn}$ the high pressure filter for the case in which a dynamic time constant according to FIG. 6 is used for the high pressure filter. A progression of the target high pressure $p_{soll}^{stat}$ is indicated for comparison with the broken line, in case that a constant time constant of 2.0 seconds is used. In steady state operation the target high pressure always has a value of 1200 bar before time point $t_1$. By increasing the load and simultaneous decline of the engine speed the target high pressure respectively begins to increase. Before the high pressure filter $p_{soll}^{KF}$ the target high pressure reaches its steady state end value of 1800 bar at time point $t_5$, since at this time point the engine speed $n_{ist}$ and the target torque $M_{soll}$ are built up to their steady state final values.

The target high pressure after the filter reaches the steady state final value at time point $t_7$ if the dynamic time constant $T_{dyn}$ is used, which is illustrated by the dotted line $p_{soll}^{dyn}$. If a constant time constant of 2.0 seconds is used, then the target high pressure reaches its steady state final value only at time point $t_9$. One recognizes that a dynamic filter time constant facilitates a better transitional performance of the target high pressure than a static or respectively constant filter time constant, without having to accept a deterioration of the steady state filter performance.

The described method offers, at least in some of the embodiments, several advantages: A better transitional performance of the target high pressure is achieved in transient operation. This allows for emissions to be reduced in transient engine operation. Moreover, a better acceleration performance of the engine is achieved with increasing target high pressure, since the target high pressure in this case increases faster and a higher high pressure is advantageous for the dynamic performance. Moreover, this provides more freedom in designing the high pressure performance characteristics graph (high pressure demand map) since steep gradients in the performance characteristics graph do not lead to instabilities. In steady state operation a filter having very good filter efficiency can be used, without thereby compromising the transient operation.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method to regulate rail pressure in an internal combustion engine, comprising the steps of:

regulating a rail pressure using a controller;

filtering a preset target high pressure using a target high pressure filter prior to inputting said preset target high pressure into a control system; and using a dynamic target high pressure filter as said target high pressure filter, having a filter parameter that is varied, dependent on an operational state of said internal combustion engine.

2. The method according to claim 1, wherein:

a time constant of said target high pressure filter is varied as said filter parameter.

3. The method according to claim 1, wherein:

a filter angle is varied as said filter parameter.

4. The method according to claim 1, wherein:

a suction throttle is used as a pressure regulator.

5. The method according to claim 1, wherein:

possible operational states of said internal combustion engine include a steady state operation state and a transient operation state.

6. The method according to claim 5, wherein:

in said steady state operation state, said filter parameter is selected to a value of about 2 seconds.

7. The method according to claim 5, wherein:

in said transient operation state, said filter parameter is selected to a value of about 0.02 seconds.

8. The method according to claim 5, wherein:

differentiation between said steady state operation state and said transient operation state depends upon a transient air mass ratio as a decisive value.

9. The method according to claim 8, wherein:

said filter parameter is calculated over a curve from said transient air mass ratio.

10. An arrangement to regulate rail pressure in an internal combustion engine for implementation of the method according to claim 1, wherein:

said controller into which said target high pressure is input has said target high pressure filter designed dynamically, and has said filter parameter being variable in dependency on said operational state of said internal combustion engine.

11. The arrangement according to claim 10, wherein:

a PT1-filter is used as said dynamically designed target high pressure filter.

12. The arrangement according to claim 10, wherein:

a mean value filter is used as said dynamically designed target high pressure filter.

* * * * *